United States Patent [19]

Archer et al.

[11] Patent Number: 4,996,951

[45] Date of Patent: Mar. 5, 1991

[54] METHOD FOR SOOT BLOWING AUTOMATION/OPTIMIZATION IN BOILER OPERATION

[75] Inventors: David H. Archer, Ross Township, Allegheny County; M. Mushtaq Ahmed, Wilkins Township, Allegheny County, both of Pa.

[73] Assignee: Westinghouse Electric Corp., Pittsburgh, Pa.

[21] Appl. No.: 476,198

[22] Filed: Feb. 7, 1990

[51] Int. Cl.[5] ..... F22B 37/18; F22B 37/48

[52] U.S. Cl. ..... 122/379; 15/318.1; 134/18; 165/95; 122/392

[58] Field of Search ..... 122/379, 391, 392, 390, 122/382; 15/316 R, 316 A; 165/95; 134/22, 18, 169 R, 18

[56] References Cited

U.S. PATENT DOCUMENTS

| | | | |
|---|---|---|---|
| 4,454,840 | 6/1984 | Dziubakowski | 122/379 X |
| 4,466,383 | 8/1984 | Klatt et al. | 122/379 |
| 4,475,482 | 10/1984 | Moss et al. | 122/379 |
| 4,488,516 | 12/1984 | Bueters et al. | 122/379 |

*Primary Examiner*—Edward G. Favors
*Attorney, Agent, or Firm*—E. F. Possessky

[57] ABSTRACT

A system and method for controlling soot removal in a heating device (2) in which heat energy is generated by combustion of a fuel, with accompanying production of soot, to produce combustion product gases, and heat energy is transferred from the product gases to a heated medium via a heat exchange surface on which the soot collects in a layer, by: producing (10) an indication of the present thickness of the soot layer; determining (12) the increase in cost of transferring heat energy to the heated medium due to the soot layer; and performing (4) a soot removal operation starting at a time selected on the basis of the determined cost increase.

13 Claims, 3 Drawing Sheets

METHOD FOR SOOT BLOWING AUTOMATION/OPTIMIZATION IN BOILER OPERATION

BACKGROUND OF THE INVENTION

The present invention relates to systems for utilizing energy from fossil fuels, and particularly systems of this type equipped to undergo periodic removal of soot deposits.

Typical systems of this type are boilers which are fueled by coal or oil and which produce steam for driving the turbines of an electrical power generating plant. Typical boilers include, among other components, a furnace evaporator section and various heat exchange units such as superheaters, reheaters, economizers and, possibly, air heater sections. A furnace evaporator section is provided with water walls, while the various heat exchange units include tubing carrying the medium, in the form of water or steam, being heated, while combustion gases flow past the water walls and over the tubing.

Despite all efforts to optimize the fuel burning process, all combustion gases contain a certain amount of solid and/or molten products, including ash and soot which form deposits on the water walls and tubing surfaces.

These deposits interfere with the transfer of heat energy from the combustion gases to the medium being heated. Moreover, if these deposits are permitted to form a layer of a certain thickness, the outer surface of such layer may reach a temperature at which constituents thereof become sintered or molten, resulting in deposits which grow rapidly, resist removal, create partial or total blockages in the gas flow paths of the boiler, result in heavy accumulations which may fall and hence cause mechanical damage within the boiler, and cause corrosion damage due to diffusion of molten or vapor materials into the tubing surfaces.

In order to prevent such problems from occurring, it is known to equip such a boiler with soot blowers, which may be fixed, rotating and/or retractable, and which are activated periodically to direct jets of steam, air and/or water onto the surfaces where deposits form in order to effect removal of such deposits from the boiler. It is known to equip such blowers with control devices which direct the blowing nozzles toward the surfaces to be cleaned and activate the flow of the blowing medium at appropriate times. Such control devices may operate soot blowers individually or in groups on command by a boiler operator and/or according to a predetermined time pattern.

Each soot blowing operation itself involves a certain cost and current soot blowing practice does not take account of all of the costs involved in a manner to seek to optimize the economic benefits of soot blowing.

SUMMARY OF THE INVENTION

It is a primary object of the present invention to optimize the economic benefits of soot blowing.

A more specific object of the invention is to control soot blowing operations in dependence on the relation between the economic penalties of soot deposits on heat transfer surfaces and the costs of the soot blowing operations themselves.

A further specific object of the invention is to control soot blowing in a manner to prevent the occurrence of conditions which can give rise to sintered or molten deposits.

The above and other objects are achieved, according to the invention, by a method for controlling solid combustion product removal in a heating system in which heat energy is generated by combustion of a fuel, with accompanying production of solid and gaseous combustion products, and heat energy is transferred from the product gases to a heated medium via a heat exchange surface on which the solid combustion products collect in a layer, comprising: producing an indication of the present thickness of the solid combustion product layer; determining the increase in cost of heat energy transferred to the heated medium due to the solid combustion product layer; and performing a solid combustion product removal operation starting at a time selected on the basis of the determined cost increase.

DESCRIPTION OF THE PREFERRED EMBODIMENTS

Figure 1:
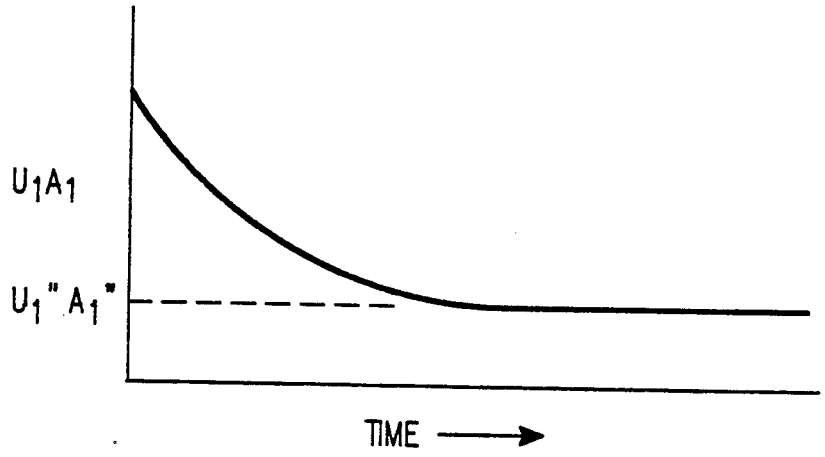
FIGS. 1 and 2 are graphs illustrating the influence of solid combustion product deposits on heat transfer in a boiler section.

In the following description, solid combustion products will be identified collectively as soot for ease of reference.

According to the present invention, soot blowing is controlled according to two separately derived criteria.

The first criterion, which will normally be employed, relates to the net economic penalty incurred as a result of soot deposits. This penalty depends on the economic value of the energy transferred to the heated medium and the cost of the fuel required to produce that energy. Additionally, the penalty will depend on specific adjustments which are made in the boiler as soot accumulates, these including adjustments in various flows to maintain a desired steam flow, temperature and pressure. As soot accumulates, the efficiency with which heat is transferred to the heated medium decreases. This will result in a decrease in the power output of the plant and/or an increase in the fuel burning rate, depending on what adjustments are made in response to the soot deposit. The overall economic penalty also includes the cost of each soot blowing operation, including the cost of the blowing media, the cost for maintenance of the blowing equipment, the costs associated with deterioration experienced by the tubing and water walls as a result of the blowing operation, and the economic penalty which continues to exist for the boiler as a whole during a blowing period and until all soot has been removed.

The second criterion is the temperature at the surface of a deposited soot layer. Independently of the economic considerations outlined above, and to be described in greater detail blow, it will generally be desired that a soot blowing operation be carried out before the layer thickness reaches a value at which sintering or melting will occur at the surface thereof.

Implementation of the first criterion employed in the practice of the present invention is based on the assumption that the economic penalty imposed by soot deposits is a linear function of the soot layer thickness and the manner of determining this thickness according to the present invention will now be described.

Based on operating data obtained while the boiler is in operation, values are derived, for example in a boiler model, for each boiler section, i, for $Q_i$, the heat transfer rate from the combustion product gases to the secondary heat exchange medium, which will typically be water, steam, or air, in units of BTU/hr, and for $\Delta_i T_{LM}$, the log mean temperature difference between the combustion product gases and the secondary heat exchange medium.

The term $\Delta_i T_{LM}$ is determined as follows: each boiler section defines a heat exchange region having an inlet and outlet for the heating medium, typically combustion gases, and an inlet and outlet for the heated medium, typically steam, water, or air, with heat exchange occurring between the media over a path between the inlets and outlets. If the temperature difference between the heating medium at the heating medium inlet and the heated medium at that point in the boiler section is $\Delta T_{in}$ and the temperature difference between the heating medium at the heating medium outlet and the heated medium at that point in the boiler section is $\Delta T_{out}$, then $$\Delta_i T_{LM} = \frac{\Delta T_{out} - \Delta T_{in}}{\ln\left(\frac{\Delta T_{out}}{\Delta T_{in}}\right)}$$

The values are used to derive, in the model, for each section, i, a value for $U_i$, the overall heat transfer coefficient in section i, in BTU.hr$^{-1}$. ft$^{-2}$.°F$^{-1}$, according to the equation $$U_i = \frac{Q_i}{\Delta_i T_{LM} \cdot A_i}, \quad (1)$$

where $A_i$ is the known effective heat transfer area of boiler section i, in ft$^2$.

For a given section i, there is a heat transfer surface portion having area $A_i'$ on which soot collects and an adjacent portion having area $A_i''$ on which soot does not collect, (for example: the tops and bottoms of tubes) with $A_i' + A_i'' = A_i$. The following equality can be established for each section:

$$U_i A_i = U_i' A_i' + U_i 41\ A_i'' \quad (2),$$

where $U_i'' A_i''$ has a known constant value, as does $A_i'$, and $$U_i' = \frac{1}{\frac{1}{h_{st}} + \frac{\delta_w}{K_w} + \frac{\delta_D}{K_D} + \frac{1}{h_g}}, \quad (3)$$

where:

$h_g$ is the heat transfer coefficient of the heating medium;

$\delta_w$ is the thickness of the heat exchange wall;

$K_w$ is the thermal conductivity of the heat exchange wall;

$\delta_D$ is the soot deposit layer thickness;

$K_D$ is the thermal conductivity of the soot deposit layer; and $h_{st}$ is the heat transfer coefficient of the heated medium.

Each term in the denominator of the right-hand side of equation (3) is in units of hr.°F. ft$^2$/BTU.

Since all terms on the right-hand side of equation (3) are known except for $\delta_D$, the value for this term can then be derived.

Figure 2:
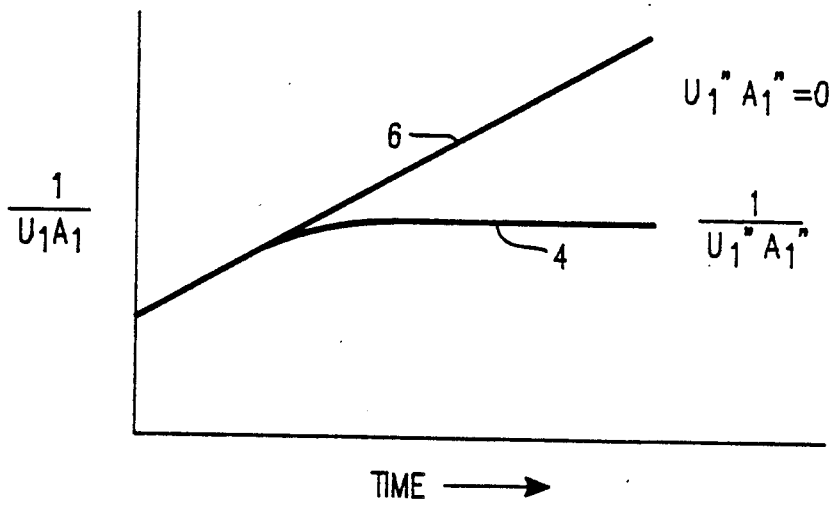

Assuming that $\delta_D$ increases linearly with time between soot blowing operations, then the variations of $U_i A_i$ and $1/U_i A_i$ will have the forms shown in FIGS. 1 and 2. In FIG. 2, curve 4 is associated with a finite value for $U_i'' A_i''$ and curve 6 relates to a zero value for $U_i'' A_i''$, i.e., for the case where soot collects over the entire area of $A_i$ of section i.

Furthermore, $\delta_D$ will be proportional to the ash flow through the boiler, the latter being equal to the fuel flow through the boiler multiplied by the ash content of the fuel. The ash content may be measured by a coal analyzer and the fuel flow can be directly measured. A value for $\delta_D$ calculated in this manner can be employed to confirm the value obtained as described above. If the values differ by more than a certain amount, a suitable advisory can be supplied to the operators.

Soot accumulations reduce the magnitudes of $U_i$, corresponding to reductions in the overall plant performance. In general, if the independent operating variables—fuel, air, feedwater and soot removal spray flow rates—are fixed, steam pressure or flow and temperature will decrease and stack temperature will increase as soot accumulates. On the other hand, if a control system is employed to maintain steam pressure, temperature and flow constant, then fuel and air flows must be increased as soot accumulates. In either event, the result of soot accumulation is an increase in the cost of the plant output. The amount of increase is dependent on the value of the output and the cost of the fuel, as well as on specific adjustments made in boiler operation as soot accumulates. For example, such adjustments might be made to various flows including fuel, air, water spray, flue gas recycle, etc., to maintain a desired steam flow, temperature and pressure.

A model of the plant can be used to calculate the economic penalty of soot accumulation based on any selected set of plant operating conditions. The effect of a linear increase in soot layer thickness, $\delta_D$, can be considered to correspond to an approximately linear increase in economic penalty rate, $P_i = a_i t$, where $a_i$ is an economic penalty rate factor based on decreased plant revenue and/or increased fuel and operating costs, in units of \$/hr$^2$, and $P_i$ is in units of \$/hr.

$P_i$ can be restored to a value of zero by a blowing operation, which has a certain cost, $C_i$, including the costs for blowing media and blower and tube maintenance, tube deterioration as a result of blowing, and the boiler performance penalty existing until completion of blowing. $C_i$ is assumed to have a fixed value, in units of \$, for each blowing operation.

Figure 3:
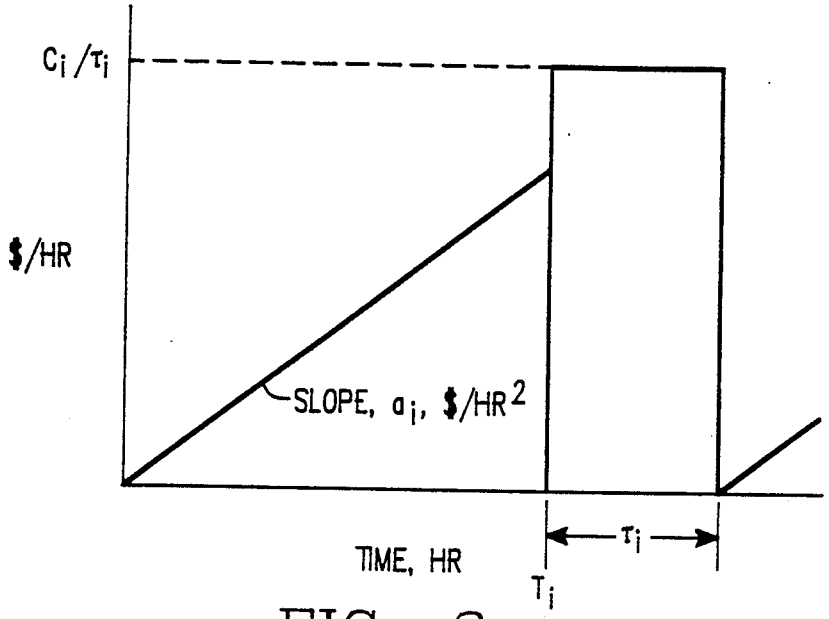
FIG. 3 is a graph illustrating the time variation of economic penalties in a boiler section associated with solid combustion product deposits and blowing.

FIG. 3 illustrates the economic penalty rate incurred during one operating period when a soot blowing operation is performed. Starting at a time, $T_{init}$, when the heat exchange surface is free of soot, the penalty rate, $P_i$, increases linearly from a value of zero. At a selected time, $T_i$, after $T_{init}$ a blowing operation is started and continues for a period $\tau_1$ which is assumed to have a preselected value substantially shorter than $T_i$. The blowing operation has a fixed economic penalty, $C_i$, and thus a penalty rate of $C_i/\tau_i$. The value of $\tau_i$ is selected to generally effect removal of all soot from the heat exchange surface so that at the end of $\tau_i$ the economic penalty rate again has a value of zero.

Thus, for the time $T_i+\tau_1$, the average economic penalty rate, $\overline{P}_i$, can be represented as:

$$P_i = \left( \int_{T_{init}}^{T_i} a_i t dt + C_i \right) / (T_i + \tau_i), \tag{4}$$

and $\overline{P}_i$ can be minimized, i.e., the cost of operating section i can be minimized, by selecting a value for $T_i$ at which $d\overline{P}_i/dt=O$. This value will be achieved if $$T_i = \tau_i + \sqrt{\tau_i^2 + 2C_i/a_i}\ .$$

Further, if $\tau_i^2 << 2C_i/a_i$, then $$T_i = \sqrt{2C_i/a_i} \tag{5}$$

Based on values for $T_i$ calculated in this manner and selected values for $\tau_i$ and the flow rate, $W_i$, of the blowing medium for each boiler section, a schedule for optimum soot blowing in each section can be developed. For this task, account must be taken of certain known factors, such as: possible limitations on the maximum flow rate of the blowing media; the possible desire to maintain a reasonably uniform flow of media; and the possible desire to carry out soot blowing during periods of reduced output demand.

Figure 4:
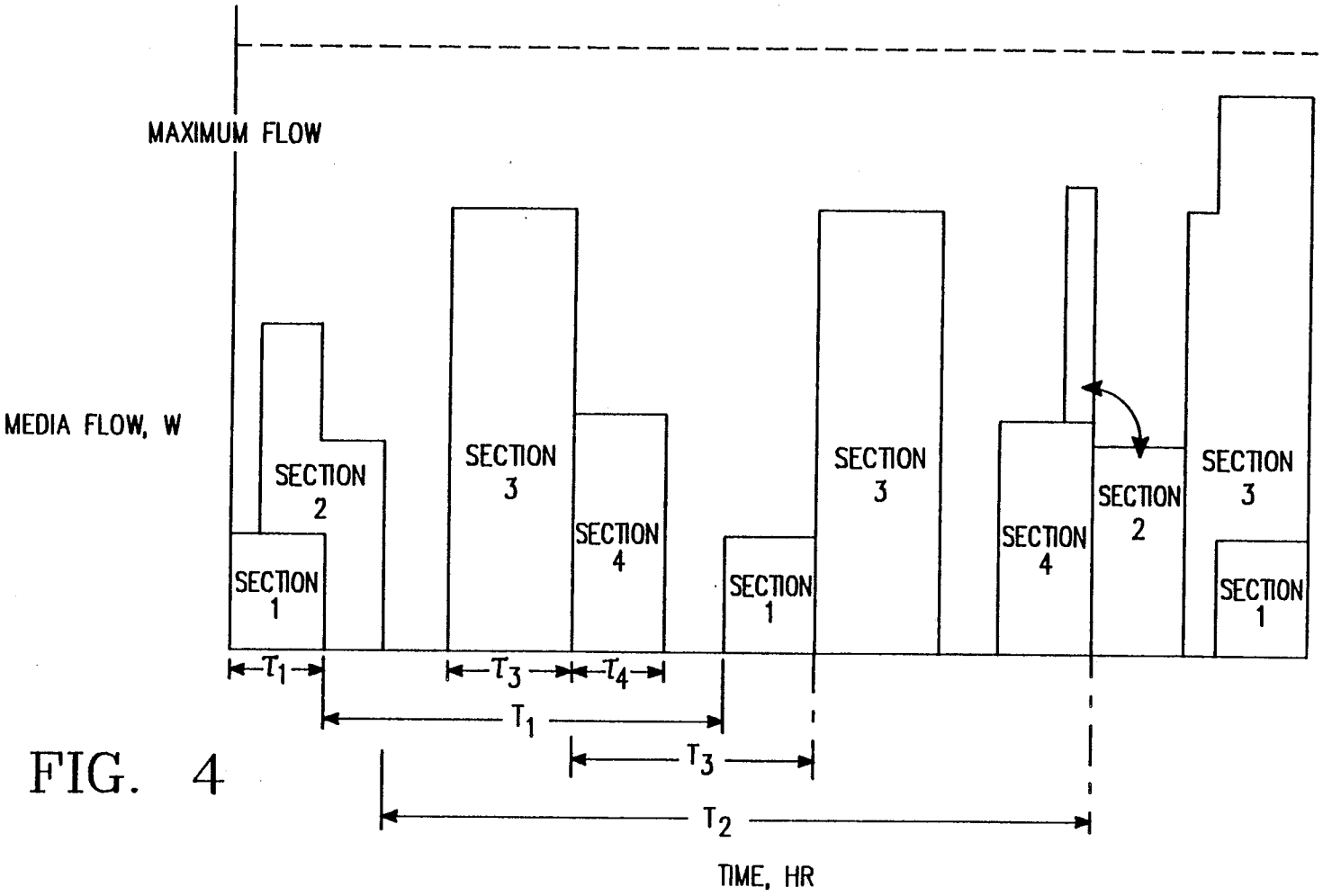
FIG. 4 is a graph illustrating an exemplary solid combustion product blowing schedule established according to the present invention.

An exemplary scheduling pattern is shown in FIG. 4, where total flow of blowing media at each moment is depicted.

In certain situations, it may be necessary to lengthen or shorten the time intervals, $T_i$, between blowing operations in each section so that the selected time intervals no longer correspond to the optimum values. It may occur that a significant lengthening, $\Delta T_i$, is required because, for example, the supply of blowing media is inadequate. In this case, $\Delta T_i$ for each section should be selected so that blowing in each section occurs at times for which all $d\overline{P}i/dt$ have the same value.

What has been discussed thus relates to determination of optimum blowing time on the assumption that soot deposition occurs uniformly in a section and a single soot blowing operation is performed on the entire section. However, certain sections may be arranged to have several portions in which soot blowing can be carried out separately. For example, a given section may have left and right portions which can be individually subjected to soot blowing. In this case, a soot blowing schedule should be separately developed for each portion.

The total heat transfer rate in the clean section can be defined as follows:

$$Q_i=(U_{iL}.A_{iL}+U_{iR}.A_{iR}).\Delta_i T_{LM}$$

where L and R designate the left and right portions, respectively. When the entire section is clean of soot, $U_{iL}$ and $U_{iR}$ have initial values $U_{iLA}$ and $U_{iRA}$, which are assumed to be equal to one another. The values of $A_{iL}$ and $A_{iR}$ are determined from the geometry of the section and are thus unvarying, and $Q_i$ and $\Delta_i T_{LM}$ are determined as described earlier, each of these values relating to the entire section. The equation permits calculation of $U_{iLA}=U_{iRA}$ from measurements of Qi and $\Delta_i T_{LM}$.

After a given period of operation of the section, when a layer of soot has accumulated in both portions, new heat transfer coefficient values, $U_{iLB}$ and $U_{iRB}$, are obtained, which values cannot be directly calculated. At the end of that period of operation, one portion is blown clean, for example the right portion, so that the heat transfer coefficient values are $U_{iLB}$ and $U_{iRA}$. Before and after this blowing operation, $Q_1$, $\Delta T_{our}$, and $\Delta T_{IN}$ values are determined, and based thereon values for $U_{iA}$, $U_{iLB}$ and $U_{iRB}$ can be determined. The latter values can then be used to calculate blowing times, $T_i$, for each portion.

Successful long term operation of systems which receive heat from combustion gases requires the avoidance or minimization of deposits which are hard, sintered, or molten and which, therefore, are difficult to remove. Such deposits are formed from the combustion gas ash or soot and are the result of slagging in radiant sections of a furnace, or fouling in the superheater or reheater of a convection section, or reactive sintering in an economizer or air heater.

Such deposits are formed when the upper surface of a soot layer reaches its sintering or melting temperature. Under given operating conditions, the temperature, $T_D$, of the upper surface of a soot layer is proportional to the thickness, $\delta_{Do}$, of the layer. Therefore, the time at which blowing must occur to prevent the soot layer in a section from reaching its sintering point can be calculated on the basis of the soot layer thickness determination as follows:

As indicated earlier herein, for the portion of a section on which soot collects, $$\frac{1}{U} = \frac{1}{h_{st}} + \frac{\delta_w}{K_w} + \frac{\delta_D}{K_D} + \frac{1}{h_g} \tag{6}$$

Each term is representative of thermal resistance and the four terms of the right-hand side of equation (6) are thus representative of four thermal resistances in series between the gas combustion region and the heated medium. The temperature in the gas combustion region is the combustion temperature $T_G$, which is calculated in the model on the basis of data indicating fuel type and delivery rate and combustion air temperature and delivery rate. The temperature of the heated medium, $T_{ST}$ is determined by measurements taken in the boiler section under consideration.

Since the change in temperature along any part of the heat flow path between the locus of combustion and the heated medium is linearly proportional to thermal resistance, it can easily be demonstrated that:

$$\frac{T_D - T_{ST}}{T_G - T_{ST}} = U\left( \frac{\delta_D}{K_D} + \frac{\delta_W}{K_W} + \frac{1}{h_{st}} \right) \tag{7}$$

Since all terms other than $T_D$ can be determined as described earlier, this calculation yields the current value for $T_D$. This can then be compared with the known sintering temperature of the ash composition being produced to provide a signal for initiating a soot blowing operation.

It is known that the sintering temperature of the soot being deposited is a function of the initial composition of the ash contained in the fuel which, in the case of coal, can be determined by a coal analyzer.

In addition, a secondary measurement which can be used to aid in the calculation of the presence of a deposit is the combustion gas pressure loss over a boiler section.

If a soot blowing operation is initiated in this manner, then at the end of such operation, a new time period is started for the economic optimization cycle described earlier.

According to further aspects of the invention, a determination that a soot layer is accumulating can serve to initiate one or more of the following control operations intended to avoid the occurrence of slagging, fouling or sintering:

Increasing the air/fuel and/or recirculated flue gas/fuel ratios. This will reduce gas and surface temperatures in radiant sections of the boiler. However, surface temperatures in convection sections of the boiler may increase due to an increased convective heat transfer coefficient between the gases and the heat transfer surface;

Reducing the fuel flow. This will reduce both the gas and surface temperatures, but will also reduce the rate of heat transfer and the rate of steam generation;

Altering the fuel composition. This may include reducing the quantity of ash in the fuel by blending low ash fuel; altering the acid/base ratio or ash sintering temperature by mineral additives; adding alkali sorbents; periodically injecting mineral additives to produce dry, friable layers in boiler deposits.

One or more of these measures could be taken to delay the occurrence of slagging, fouling or sintering until the deposit layer has reached a thickness at which blowing would be performed for purposes of economic optimization.

Other measures are available for delaying or preventing the creation of slag deposits, but such measures are likely to be more costly than the soot blowing approach.

Figure 5:
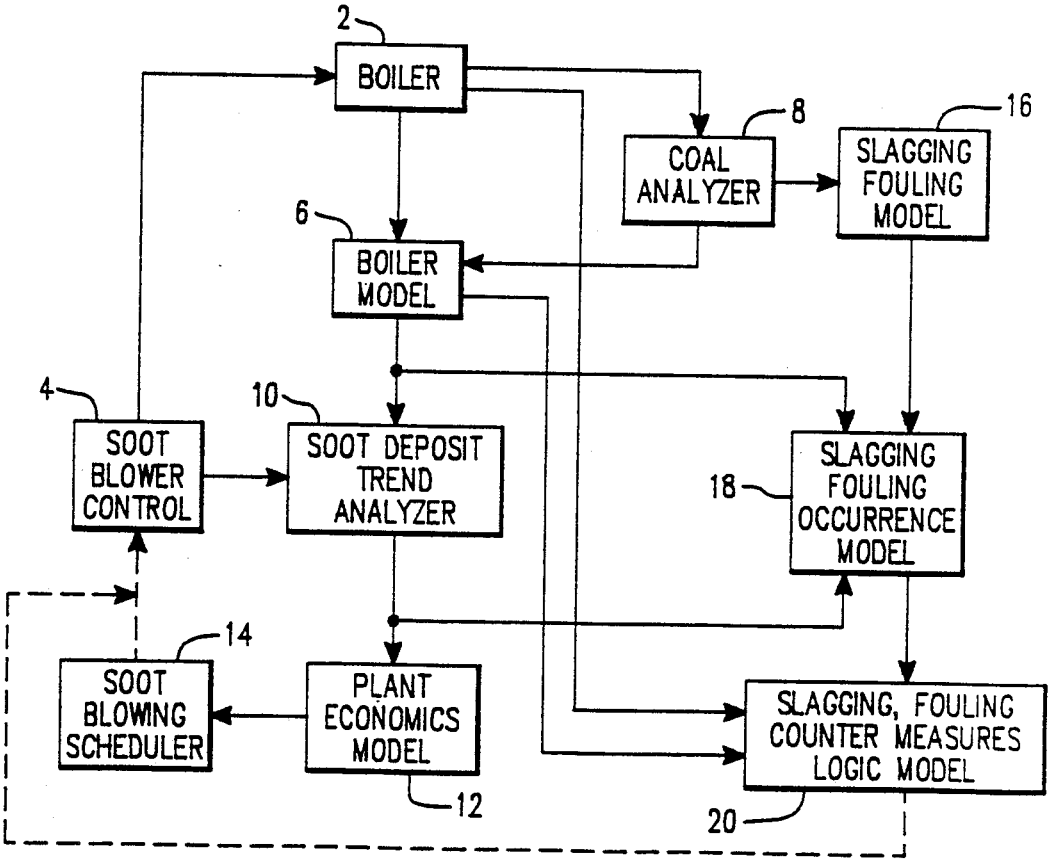
FIG. 5 is a block diagram of a system for implementing the present invention.

FIG. 5 is a block diagram of one embodiment of a system according to the present invention. This system is composed essentially of two sections: an efficiency optimization section and a slagging/fouling prevention section. The efficiency optimization section determines the timing for the removal of loose deposits in each section, or in each portion of a section, of the boiler to balance the costs of soot blowing with the economic benefits of reducing heat transfer losses. The slagging/fouling prevention section determines the existence of conditions which indicate an incipient slagging or fouling condition.

The system shown in FIG. 5 includes the boiler 2 which is to be monitored and controlled and which is equipped with conventional soot blowing devices whose operation will be controlled by a soot blower control 4.

Measured operating parameters of boiler 2 are conducted to a boiler model 6. These parameters include input and output steam temperatures, pressures, flow and composition, internal water and steam temperatures and both gas and steam pressure differentials. Model 6 may be any known boiler model, examples of which are a PEPSE boiler model marketed by EIS Systems Group of EI International, Inc., of Idaho Falls, Id., or a model sold under the designation SYNTHA, or a model constructed on the basis of a modular system disclosed by EPRI.

The boiler shown in FIG. 5 is assumed to be a coal fired boiler and is connected to a coal analyzer 8 which produces a coal ultimate analysis and a measure of coal flow, which values are supplied to model 6, as well as an ash analysis.

Boiler model 6 derives values for the gas combustion temperature, the values for UA for each section, or each portion of a section, values for ($\delta_D/K_D$) and deposit surface temperatures for each section or of a section. This information is supplied to a soot deposit trend analyzer 10 together with an indication of the performance of a soot blowing operation in each section or portion of a section. On the basis of this information, analyzer 10 produces indications of the trends experienced by the product UA in each section or each portion of a section. This information is supplied to a plant economics model 12 which is supplied with economic information including plant objectives, power, intended heat rate and cost parameters required to derive the information associated with the diagram of FIG. 3. Based on this information, and in accordance with equations (4) and (5), economics model 12 derives an indication of the optimum time to effect soot blowing in each section or portion of a section.

This information is supplied to a soot blowing scheduler 14 which, in the system according to the present invention, supplies indications to an operator who can then actuate control 4 in order to initiate a soot blowing operation in a particular section or portion of a section.

Data produced by the ash analysis performed in analyzer 8 is supplied to a slagging, fouling potential model 16 which utilizes this information, together with stored information regarding various ash compositions to derive an indication of critical slagging/fouling temperatures, as well as other information relevant to the occurrence of these conditions. This data is supplied to a slagging, fouling occurrence model 18 which also receives the previously described data from boiler model 6 and produces an indication of the likelihood of the occurrence of slagging, fouling, etc., in each boiler section or sectional portion. This information is supplied to a slagging, fouling countermeasures logic model 20 together with measured values from boiler 2 and relevant values from model 6, on the basis of which model 20 compares the value of a soot blowing operation to prevent slagging or fouling, or the desirability of alternative responses, as described earlier herein. The output of model 20 is in the form of indications to an operator, on the basis of which the operator can initiate a soot blowing operation.

Each of the devices shown in FIG. 5 can be constructed according to principles well known in the art on the basis of the information provided above and the knowledge already possessed in the art relative to the control of boiler operation.

While initiation of soot blowing could be automated, current experience reveals that there is a higher degree of safety in providing indications to human operators, who can then act on those indications, taking into account their own experience.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method for controlling soot removal in heating system in which heat energy is generated by combustion of a fuel, with accompanying production of soot, to produce combustion product gases, and heat energy is transferred from the product gases to a heated medium via a heat exchange surface on which the soot collects in a layer, comprising: producing an indication of the present thickness of the soot layers; determining the increases in cost of transferring heat energy to the heated medium due to the soot layer; determining the temperature of the surface of the soot layer providing an indication of the sintering or melting temperature of the soot; and performing a soot removal operation starting at the earlier one of: a time selected on the basis of the determined cost increase, and a time before the temperature obtained in said soot layer determining step exceeds the sintering or melting temperature.

2. A method as defined in claim 1 wherein said step of performing is carried out periodically and each soot removal operation has a fixed cost, and further comprising selecting the time which is based on the determined cost increase in order to minimize the sum of the increased cost of transferring heat energy to the heated medium due to the soot layer and the cost of all soot removal operations.

3. A method as defined in claim 2 wherein the selected starting time of a soot removal operation based on the determined cost increase occurs at a time interval after the end of a previous soot removal operation which is at least substantially equal to:

$$\sqrt{2C/a},$$

where

C is substantially equal to the cost of the soot removal operation; and a is the rate of change of the increase in cost of transferring heat energy to the heated medium.

4. A method as defined in claim 3 wherein C further includes the increase in cost of transferring heat energy to the heated medium during the soot removal operation.

5. A method as defined in claim 1 wherein the heating system has a plurality of sections, combustion product gases flow through each section, and said steps of producing an indication, determining the increase in cost, and performing a soot removal operation are carried out individually for each section.

6. A method as defined in claim 1 wherein the heat exchange surface has two portions which can each be individually subjected to soot removal, and said steps of producing an indication, determining the increase in cost, and performing a soot removal operation are carried out individually for each portion.

7. A method as defined in claim 1 wherein said step of producing an indication of the present thickness of the soot layer comprises: determining the fuel flow through the system determining the ash content of the fuel; and deriving the indication of present soot layer thickness of the tube basis of the determined fuel flow and ash content.

8. A system for controlling soot removal in a heating system in which heat energy is generated by combustion of a fuel, with accompanying production of soot, to produce combustion product gases, and heat energy is transferred from the product gases to a heated medium via a heat exchange surface on which the soot collects in a layer, comprising: means for producing an indication of the present thickness of the soot layer; means connected for determining the increase in cost of transferring heat energy to the heated medium due to the soot layer; means for determining the temperature of the surface of soot layer; means for providing an indication of the sintering or melting temperature of the soot; and the means connected for performing a soot removal operation starting at a time selected on the basis of the determined cost increase and means for providing an indication that a soot removal operation should be performed before the temperature determined by said means for determining the temperature of the surface of the soot layer exceeds the sintering or melting temperature.

9. A system defined in claim 8 wherein said means for performing a soot removal operation are operated periodically and each soot removal operation has a fixed cost, and further comprising means for selecting the time of each soot removal operation in order to minimize the sum of the increased cost of transferring heat energy to the heated medium due to the soot layer and the cost of all soot removal operations.

10. A system as defined in claim 9 wherein the selected starting time of a soot removal operation occurs at a time interval after the end of a previous soot removal operation which is at least substantially equal to:

$$\sqrt{2C/a},$$

where

C is substantially equal to the cost of the soot removal operation; and a is the rate of change of the increase in cost of transferring heat energy to the heated medium

11. A system as defined in claim 10 wherein C further includes the increase in cost of transferring heat energy to the heated medium during the soot removal operation.

12. A system as defined in claim 8 wherein the heating system has a plurality of sections, combustion product gases flow through each section, and said means for producing an indication, said means for determining the increase in cost, and said means for performing a soot removal operation are operative individually for each section.

13. A system as defined in claim 8 wherein the heat exchange surface has two portions which can each be individually subjected to soot removal, and said means for producing an indication, said means for determining the increase in cost, and said means for performing a soot removal operation are operative individually for each portion.

* * * * *